United States Patent [19]

Juhlke et al.

[11] Patent Number: 4,925,583

[45] **Date of Patent: * May 15, 1990**

[54] PERFLUOROPOLYETHER SOLID FILLERS FOR LUBRICANTS

[75] Inventors: Timothy J. Juhlke; Thomas R. Bierschenk, both of Roundrock; Richard J. Lagow, Austin, all of Tex.

[73] Assignee: Exfluor Research Corporation, Austin, Tex.

[ * ] Notice: The portion of the term of this patent subsequent to Feb. 7, 2006 has been disclaimed.

[21] Appl. No.: 306,925

[22] Filed: Feb. 6, 1989

Related U.S. Application Data

[63] Continuation of Ser. No. 893,640, Aug. 6, 1986, Pat. No. 4,803,005.

[51] Int. Cl.[5] ..... C10M 105/52

[52] U.S. Cl. ..... 252/58; 252/54

[58] Field of Search ..... 252/58, 54

[56] References Cited

U.S. PATENT DOCUMENTS

| | | | |
|---|---|---|---|
| 3,226,323 | 12/1965 | Stemniski | 252/58 |
| 3,505,229 | 4/1970 | Skehan | 252/58 |
| 3,536,624 | 10/1970 | Christian | 252/58 |
| 3,723,317 | 3/1973 | Ulery | 252/58 |
| 4,324,673 | 4/1982 | Christian | 252/58 |
| 4,472,290 | 9/1984 | Caporiccio et al. | 252/58 |
| 4,585,567 | 4/1986 | Strohbach | 252/58 |
| 4,803,005 | 2/1989 | Juhlke et al. | 252/58 |

OTHER PUBLICATIONS

DuPont, Technical Bulletin, "Krytox® Fluorinated Lubricants".

J. T. Skehan, "The Development of Fluorinated Greases for Aerospace, Military & Industrial Applications", Petroleum Laboratory, Dupont presented at 37th Annual Meeting of the National Lubricating Grease Institute, Kansas City, Mo., Oct. 27-30, 1969.

*Primary Examiner*—Jacqueline V. Howard
*Assistant Examiner*—Margaret B. Medley
*Attorney, Agent, or Firm*—Hamilton, Brook, Smith & Reynolds

[57] ABSTRACT

Lubricants comprising perfluoropolyether oils containing perfluoropolyether solids as fillers are described.

3 Claims, No Drawings

PERFLUOROPOLYETHER SOLID FILLERS FOR LUBRICANTS

RELATED APPLICATIONS

This application is a continuation of U.S. patent application Ser. No. 893,640, filed Aug. 6, 1986 now U.S. Pat. No. 4,803,005.

FIELD OF THE INVENTION

This invention is in the field of polymer chemistry and pertains to lubricant compositions comprising perfluoropolyether oils containing perfluoropolyether solid fillers.

BACKGROUND OF THE INVENTION

Perfluoropolyethers have long been recognized for their outstanding thermal properties and their wide liquid ranges. These properties make the polymers outstanding bases for high performance lubricants. Most perfluoropolyether lubricants are comprised of perfluoropolyether oils containing polytetrafluoroethylene (TFE; Teflon TM polymer) fillers which serve to thicken the oil into a paste. However, some problems are associated with perfluoropolyether-based lubricants containing Teflon TM polymer as filler.

Although these greases have adequate shelf lives often exceeding several years, they have a tendency to separate into two phases, an oil phase and a solid phase, when subjected to high temperatures. For example at 400° F., approximately 11% of the oil in a Teflon TM-based Krytox TM grease separates in 30 hours into a clear phase leaving behind a much thicker paste. The degree of separation is much more pronounced as the temperature is raised still higher.

SUMMARY OF THE INVENTION

This invention pertains to lubricant compositions comprising perfluoropolyether oils and a thickening amount of perfluoropolyether solid fillers. In most embodiments, the perfluoropolyether solid filler comprises about 10 to about 70% by weight of the compositions, depending upon the viscosity of the base perfluoropolyether oil, the particle size of the solid, and desired thickness of the lubricant composition. The lubricants can be prepared by simply mixing the perfluoropolyether solid and the perfluoropolyether oil.

Greases made using perfluoropolyethers as thickeners do not exhibit this separation phenomenon since the oil and solid, being of the same composition, are extremely compatible. Other noteworthy advantages associated with these lubricants relate to the stability and the mechanism of decomposition. Most perfluoropolyethers are approximately 50° C. more stable than Teflon TM so the useful temperature range of the grease can often be extended. Furthermore, unlike Teflon TM, perfluoropolyethers decompose cleanly into only gaseous and liquid by-products without leaving behind a carbonaceous residue. This unique advantage makes lubrication of very high temperature surfaces possible if a system is designed to continuously feed the lubricant onto the surface to be lubricated.

The greases are useful lubricants for aircraft components, missiles, satellites, space vehicles and attendant ground support systems. Their high degree of chemical inertness make them useful lubricants for food processing equipment, for valves and fittings, and for use in high vacuum environments, pneumatic systems and cryogenic apparati.

DETAILED DESCRIPTION OF THE INVENTION

The lubricant compositions of this invention are greases comprising perfluoropolyether oils filled with perfluoropolyether solids. The solids are employed in amounts sufficient to thicken the lubricant. In most applications, the solid filler comprises about 10 to about 70 percent by weight of the grease, preferably about 15 to about 40 percent by weight.

The amount of perfluoropolyether solid required to thicken the grease is generally dependent upon the particle size of the solid. Ideally, a very fine particle is desired so that a minimal amount of thickener is required. Very fine particles in the micron size range (e.g. passing 400 mesh) can be made by direct fluorination in a liquid phase system as described in U.S. patent Ser. No. 250,376, filed Sept. 28, 1988, entitled "Liquid Phase Fluorination". Preferably, the starting material for the liquid phase fluorination is a polyether of 20,000 amu or higher. Powder of approximately 200 mesh can presently be made by direct fluorination of fine particles of the hydrocarbon polyether. If larger particles are fluorinated, then cryogenic grinding of the perfluoropolyether solids with liquid nitrogen can be used to obtain the fine particles.

Suitable perfluoropolyether oils for the lubricant compositions include Du Pont's Krytox TM fluid, Montedison's Fomblin Y TM fluid and Fomblin Z TM fluids, Daikin's Demnum TM fluid as well as other perfluoropolyethers which can be made by direct fluorination of hydrocarbon polyethers. These include the perfluorinated copolymers of hexafluoroacetone and cyclic oxygen-containing compounds described in U.S. patent application Ser. No. 756,781, entitled "Perfluorinated Polyether Fluids", filed July 18, 1985; the 1:1 copolymer of difluoromethylene oxide and tetrafluoroethylene oxide described in U.S. patent application Ser. No. 796,625, entitled "A 1:1 Copolymer of Difluoromethylene Oxide and Tetrafluoroethylene Oxide", filed Nov. 8, 1985; perfluoropolymethylene oxide and related perfluoropolyethers containing high concentrations of difluoromethylene oxide units described in U.S. patent application Ser. No. 796,622, entitled "Perfluoropolyethers", filed Nov. 8, 1985.

The choice of perfluoropolyether solid may vary depending upon the application. However, for most applications, a solid perfluoropolyether having a composition identical to that of the fluid is usually desired. By matching the solid with the fluid, the thermal stability of the solid matches that of the oil and the compatibility of the solid with the fluid is obviously maximized. For example, perfluoropolyethylene oxide fluid can be used with perfluoropolyethylene oxide solids. If a commercial fluid such as Krytox TM, Fomblin Y TM, Fomblin Z TM or Demnum TM is used, a comparable said polyether can be made using direct fluorination technology. For example, the fluorination of high molecular weight (750,000 amu) poly(propylene oxide) gives a solid polyether with a composition identical to that of Krytox TM or Fomblin Y TM fluids. Similarly, the fluorination of poly(methylene oxide ethylene oxide) copolymer (U.S. patent application Ser. No. 796,625) and poly(trimethylene oxide) can be used to prepare solid perfluoropolyethers with compositions similar to that of Fomblin Z TM and Demnum TM fluids, respectively.

For the most part, the perfluoropolyethers prepared by direct fluorination are free-flowing white powders. They are usually prepared by mixing a high molecular weight polyether powder (50,000 amu or higher) with a hydrogen fluoride scavenger such as sodium fluoride (1:3 ration). The polyether/sodium fluoride mixture is then placed in a rotating drum through which gaseous fluorine diluted with nitrogen is passed. Reaction times of 6–24 hours are usually employed while initial fluorine concentrations of 10–30% work well. A final treatment at elevated temperatures 60°–150° C. in pure fluorine is typically required to insure perfluorination. Yields varying between 75 and 90% are usually obtained with yields between 80 and 85% being most common. The perfluoropolyether product is usually separated from the hydrogen fluoride scavenger by dissolution of the scavenger in water.

The lubricants of this invention are generally prepared by simply mixing the solids with the oil and allowing the two to stand for approximately 12 hours. Heating the mixture to a temperature below the decomposition temperature helps to decrease the time required for the grease to reach its final form which is a transparent gel. In order to improve the clarity and homogeneity of the grease, it can be forced through a high-pressure, low porosity filter. Alternatively, the perfluoropolyether oil can be dissolved in a solvent such as Freon 113 to decrease the time required for the oil to wet out the solids. When preparing grease using this approach, thickener is mixed with the solvent/oil mixture and the solvent is evaporated using elevated temperatures leaving behind a grease which can be then filtered immediately.

In order to improve the clarity and homogeneity of the grease, it can be further blended in a variety of ways. For example, the grease can be blended in a high shear mixer such as a Waring TM blender to obtain a grease of creamier consistency. Alternatively, the grease can be forced between parallel rollers to improve consistency.

There are several advantages to using perfluoropolyether solids rather than Teflon TM polymer as a filler. Polyether solids, being of identical or very similar structure to the perfluoropolyether fluids, show no evidence of separation since the affinity of the fluid for the solid is essentially the same as the affinity of the fluid for itself. Thus, the driving force for partitioning has been eliminated. Perfluoropolyether solids do not melt or fuse like TFE or FEP Teflon TM polymers. For example, if a Teflon TM polymer filled grease is placed next to a perfluoropolyether solid filled grease on a hot plate, the Teflon TM filled grease separates around the edges to an oil and a crust of solid Teflon TM at about 400° C. Under the same conditions, the perfluoropolyether solids filled greases do not separate and the only observable change in the lubricant is a slight thickening with time. No crust is formed against the hot surface and the grease retains much more of the original perfluoropolyether oil.

Another advantage is that the perfluoropolyether solids have essentially the same properties as the oil especially if the same structure is used. The perfluoropolyether solids, like the oil, leave no residue when they are decomposed. In contrast, Teflon TM polymer leaves about a two percent residue when decomposed at high temperatures.

As mentioned, the thermal stability of the perfluoropolyether solids can be matched to the oil by using solids that have the same structure (i.e., use perfluoropropylene oxide solid in perfluoropropylene oxide oils). However, it does not appear to be necessary to use the same structure to get the advantages listed including the improved compatibility. By using the same structure in the solids and the oil, it may be possible to use the grease to lubricate parts that are above the decomposition temperature by continuously feeding the grease. With a Teflon TM filled grease, the residue might present some problems with this approach.

The invention is further illustrated by the following examples.

EXAMPLE 1

20 grams of perfluoropoly(ethylene oxide) solids (pass 100 mesh) were mixed with 30 grams of a 5000 amu perfluoropoly(ethylene oxide) fluid. The resulting paste was treated at 200° C. for one hour, then filtered through a 50 micron filter to give a clear gel.

EXAMPLE 2

20 grams of perfluoropoly(ethylene oxide) solids (pass 100 mesh) were mixed with 30 grams of a 500 amu perfluoropoly(ethylene oxide) fluid and 100 cc Freon 113. The resulting mixture was placed on a hot plate in order to evaporate the Freon. The resulting paste was filtered to give a clear gel.

EXAMPLE 3

20 grams of perfluoropoly(ethylene oxide) solids (pass 200 mesh) were mixed with 40 grams of a 5000 amu perfluoropoly(ethylene oxide) fluid. The grease was allowed to stand for 24 hours, then filtered to give the finished product.

EXAMPLE 4

100 grams of poly(propylene oxide) solids prepared from propylene oxide using a ferric chloride catalyst was fluorinated with 20% fluorine (0° C.) in a 24 hour reaction to give 150 grams of a viscous, Freon 113-soluble fluid plus 60 grams of perfluoropoly(propylene oxide) solids. The solids were ground cryogenically to a 100 mesh powder. 20 grams of the powder were mixed with 35 grams of Krytox TM 143AB fluid along with 100 cc of Freon 113. The Freon was removed by placing the mixture in a vacuum oven. A clear gel was obtained upon filtering.

EXAMPLE 5

20 grams of high molecular weight perfluoropoly(methylene oxide-ethylene oxide) solids were cryogenically ground to a 200 mesh powder and mixed with 50 grams of Fomblin TM Z-25. The perfluoropoly(methylene oxide-ethylene oxide) solids were prepared by polymerizing 1,3-dioxolane (1M) with trifluoromethane sulfonic acid ($9\times10^{-5}$M) in methylene chloride (1M). The product, a viscous solution, was mixed with NaF powder (9.7M) and the methylene chloride was evaporated in a 50° C. vacuum oven. The resulting solids were ground to a 200 mesh powder and fluorinated with 20% fluorine (6M) in a 24 hour reaction. The sodium fluoride was removed from the perfluorinated product by extraction with water (75L).

EXAMPLE 6

A perfluoropolyether fine powder (approximately 1 micron) was prepared by dissolving 146 g of an 8,500 a.m.u. poly(ethylene glycol) in 354 g of chloroform containing 564 g of 1,1,2-trichlorotrifluoroethane. The viscous solution was slowly pumped into a 10° C. reactor containing 5 liters of 1,1,2-t richlorotrifluoroethane and 800 g of sodium fluoride. Twenty percent fluorine, diluted with nitrogen, was metered into the reactor throughout the reaction which lasted approximately 28 hours. Following the reaction, the product was filtered to give a clear filtrate which contained 14.5 g of a polymeric fluid (3.8%). The insoluble portion of the product consisted of sodium fluoride, sodium bifluoride and perfluoropoly(ethylene oxide) solids (81% yield) having the following structure:

$$CF_3O(CF_2CF_2O)_nCF_3$$

The sodium fluoride and bifluoride were dissolved away with water.

EXAMPLE 7

Fourteen grams of perfluoropoly(ethylene oxide) solids (pass 400 mesh) prepared as in Example 6 were mixed with 100 g of Demnum TM 5-100 fluid. The mixture was blended for approximately 10 minutes in a high speed mixer to give a clear gel.

EXAMPLE 8

Thirteen grams of a very fine perfluoropolyethylene oxide solid were mixed with 100 g of polyhexafluoropropylene (Aflunox TM) 14013 perfluorinated fluid to give a clear gel upon mixing in a high speed mixer for several minutes. The grease showed no tendency to separate upon standing on a hot plate at 200° C. for several hours.

Equivalents

Those skilled in the art will recognize, or be able to ascertain using no more than routine experimentation, many equivalents to the specific embodiments of the invention described herein. Such equivalents are intended to be encompassed by the following claims.

We claim:

1. A lubricant comprising a perfluoropolyether oil base and about 10 to about 70 weight percent of a perfluoropolyether solid as filler.

2. A lubricant of claim 1, wherein the oil and the solid are polymers of the same chemical structure.

3. A lubricant of claim 1, wherein the perfluoropolyether oil or solid is selected from the group consisting of perfluoropoly(ethylene oxide) perfluoropoly(propylene oxide), and perfluoropoly(methylene oxide-ethylene oxide).

* * * * *